US005780756A

United States Patent [19]

Babb

[11] Patent Number: 5,780,756

[45] Date of Patent: Jul. 14, 1998

[54] SUPPORT FOR SHOULDER-ENGAGEABLE MUSICAL INSTRUMENT

[76] Inventor: Nathaniel D. Babb, 28 Fawndale Rd., Apt. 1R, Roslindale, Mass. 02131

[21] Appl. No.: 560,301

[22] Filed: Nov. 17, 1995

[51] Int. Cl.[6] ..... G10D 1/02

[52] U.S. Cl. ..... 84/280

[58] Field of Search ..... 84/278, 279, 280, 84/281

[56] References Cited

U.S. PATENT DOCUMENTS 1,315,015 9/1919 Doyle ..... 84/280

4,389,916 6/1983 Ruthstrom ..... 84/278

4,913,027 4/1990 Twohy ..... 84/280

*Primary Examiner*—Cassandra C. Spyrou

*Attorney, Agent, or Firm*—Lappin & Kusmer LLP

[57] ABSTRACT

An instrument holder configured so as to fit around the neck of the user and engage a portion of the chest, allowing the user to support the instrument without clenching the instrument between the chin and shoulder as is now customary. The invention further includes an attaching mechanism that allows the user to easily attach and detach the violin from the supporting brace assembly. The device is of low profile and can be designed to easily fit in a case alongside the instrument. It is of simple construction and is an improvement over the prior art.

12 Claims, 4 Drawing Sheets

SUPPORT FOR SHOULDER-ENGAGEABLE MUSICAL INSTRUMENT

The invention relates to supports for musical instruments, and is particularly concerned with a holder for violins, violas and other shoulder engageable instruments, to enable the musician to play the instrument without having to engage it between his neck and shoulder.

BACKGROUND OF THE INVENTION

Violin holders and various other instrument holders have been suggested in several forms previous to this invention. For example, see U.S. Pat. No. 413,807, which uses an adjustable rod extending from a belt around the waist and clamping on the body of the instrument near the neck. U.S. Pat. No. 451,744, which uses a chinrest in conjunction with a chestrest and neck or back rest, to prevent the instrument from slipping to the right shoulder. This device is not intended to support the instrument exclusively by the neck and chest, but with the aid of pressure exerted on the chinrest. U.S. Pat. No. 1,337,459, is a wooden frame that encircles the neck to rest on the shoulder or chest, attaching with clips to the instrument at the neck as well as the tail. U.S. Pat. No. 2,061,464, uses a curved metal plate that mates with the end of the instrument. A neck support is attached to the plate via a vertical casing in a ball and socket configuration with a complex sliding adjustment mechanism. U.S. Pat. No. 2,576,018, attaches to the instrument with clips around the waist of the instrument. A harness goes around the neck and attaches to the holder. U.S. Pat. No. 4,389,916 employs a bendable bow member to rest on the chest and back, requiring chin pressure to keep the instrument in playing position. U.S. Pat. No. 4,913,027, encircles the neck and comes down on the right side of the player, employing a complex bracing structure with many contact points on the body of the user and the instrument, and a complex rod adjustment system. U.K. Pat. No 447,576 employs an adjustable band strapped over the shoulder, and attaching to the trousers, with steel clamps attaching to the instrument.

The instrument holders shown in these patents, however, have suffered from several disadvantages. They have not provided the instrument stability of the present invention; they have not been easily set up and secured to the body of the musician; they have not made allowances for avoiding undue pressure being applied to the spinal column; they have not been of sufficiently low profile and sufficiently unobtrusive when the musician is playing; they have not been sufficiently adjustable as to position for accommodating different users; they have not been of simple design to allow for ease of manufacture; they have not been as compactly storable as the present invention, so as to be easily stored in a case along with the instrument; and they have not been easily detachable from the brace portion, allowing the musician to raise and lower the instrument from playing position with relative ease.

These concerns are addressed by the features of the present invention described below.

SUMMARY OF THE INVENTION

In accordance with the present invention, a holder for a violin, viola or other shoulder-engagable musical instrument is configured so as to fit around the neck of the musician and engage from the right side of the neck, around the back of the neck and down over the collar-bone to the upper chest. The holder may be formed in two separate pieces which are attached together for use: the neck and chest-engaging portion or brace; and a clamping device that secures to the end of the violin including an insertion mechanism that allows the clamping device to secure to the brace by an inserting member fixed to the lower portion of the brace. So therefore, with the above configuration, the instrument is held in a fixed position relative to the user and need not be gripped using the chin and shoulder as is now customary.

Stability of the instrument is achieved by maintaining a secure fit of the brace around the neck, and balancing the instrument over the chest-plate that rests on the upper chest in a position that supports the weight of the instrument at its center of balance. Additional stability is gained by the user's hand contacting on the outer lever-arm of the instrument and, through the downward pressure applied by the weight of the instrument and the force of the bow on the strings. The brace portion of the holder is secured along the back and side of the neck and against the upper chest. Additionally, padding is positioned along the inner edge of the portion of the brace that contacts the neck, providing one or more contact zones along the inner circumference of the brace portion that contacts the neck. A gap is left between the padding along the inner circumference of the upper brace portion, freeing the spinal column from contact with any part of the brace. Therefore, all of the violin's weight is supported by the neck brace (except to the extent that the user wishes to hold or raise the instrument with the left hand) cushioned by one or more padded points along the neck portion, and at the chest plate. Other embodiments could employ additional points of contact on the chest or elsewhere for added stability. With this preferred configuration the musician need not use his chin and shoulder to help hold the instrument as is now the standard practice.

In a preferred embodiment, the neck brace is of sufficient rigidity that the instrument will maintain its position, horizontally, regardless of the downward pressures applied through the normal course of playing. Padding may be applied to the inner side of the chest-plate providing a more comfortable fit. Other embodiments of the chest-plate could be designed with a variable amount of flexibility, allowing the musician a greater freedom of rotation of the instrument due to the flexible nature of the chest-plate. Additionally, in other embodiments, the chest-plate could be formed of a rigid metal that has a modest amount of flexibility allowing the user to shape the chest-plate to conform to the curve of the user's chest. It should be noted that in a preferred embodiment, the chest-plate can be located as low as the breast and as high as the collar-bone. Also, the size of the user's chest would determine the size of the chest-plate. To allow for easier storage of the device in the case of the instrument, the brace portion can be designed with a hinge that would ease storage but would not compromise the rigidity of the structure which is an important feature of the invention.

Full adjustability of the support device is an important aspect of the invention. This is achieved by fashioning brace portions of the device in several different sizes. To achieve a better fit, the individual user would be provided with several different pairs of padding that could be inserted along the inner side of the brace portion that contacts the neck. The pads would be positioned to avoid contact with the spinal column. Other embodiments of the brace portion could utilize a rigid yet bendable metal band that could be shaped to fit an individual user's neck by applying a strong force to contract or expand the circular part of the brace portion that wraps around the user's neck. Other alternative embodiments could employ two sliding pieces of similar radius with screwholes to allow for adjustment to differing neck sizes. The advantage of these alternative arrangements is "one size fits all," and a more customizable fit. Additionally, alternative embodiments of the device could employ lighter materials, such as aluminum, titanium or carbon-fiber, to achieve a significant weight reduction without compromising the rigidity of the structure which is an important feature of the invention.

For clarity, it will be helpful to define the portion of the brace that contacts the neck the upper portion, and the portion below that as the lower portion.

At a position near the chest-plate on the lower portion of the brace below the bend, are screw-holes where various pronged attachments can be fixed. The pronged attachments are designed for insertion into a housing mounted on a clamping mechanism attached to the proximal end of the instrument over the tail-piece. Due to the ease of attaching and detaching inherent in the proposed prong and housing configuration, the instrument can easily be raised or lowered from the playing position, which is a necessity for users in a variety of situations. These pronged attachments are of varying conformations and angles to allow the user to adjust the tilt along the lengthwise axis of the instrument. That is, to adjust the angle of the instrument in its position, from a fixed point where the instrument is positioned at the user's neck, to various angles along the horizontal plane. Other embodiments of the device could have one prong attachment that is adjustable to any possible angle the user could desire. Additionally, along the same above mentioned line of screw-holes, the chest-plate can be adjusted up or down according to the user's preference.

The other aspect of the device is a clamping mechanism attaching at the proximal end of the instrument near the tail-piece, with a preferred embodiment attaching in a center mounted position over the tail-piece. The mechanism used for clamping is similar in design to the common chinrest but instead of the usual cup for the chin, there is a metal cross-piece with two feet that contact the top of the instrument on either side of the tail-piece, with a curved member crossing over the tailpiece. On the bottom leg of the clamping device, fixed to the underside of the instrument, is an insertion notch with screw-holes in the notch for the attachment of various insertion housings that could be configured in such a way, relative to the fixed position of the screw-hole slot, so as to allow the variable positioning of the instrument relative to the neck.

Other embodiments of the device could incorporate improved attaching mechanisms such as one insertion prong that would allow the instrument to rotate on a ball-joint and slide along a slide, allowing the instrument to be adjusted to any position the user desired. Additional alternative embodiments could employ different shaped prongs and insertion mechanisms, beveled prongs for ease of insertion or possibly a quick release mechanism similar to those used for bicycle pedals.

A future variant to the present preferred embodiment could employ insertion housings that project outward varying distances along the horizontal plane, and would in effect extend the length of the instrument, which would be particularly useful for players with long arms who may feel cramped and uncomfortable while playing an instrument of standard length.

It is therefore among the objects of the invention to improve over past instrument support devices by providing a violin, viola, or other shoulder engageable instrument, support which is very easily assembled and secured to the body, which is of very low profile in use, virtually unnoticeable on the musician, and which provides a highly stable support for the instrument, eliminating the need for the musician to use his shoulder and chin for retaining the instrument in place during playing. These and other objects, advantages and features of the invention will be apparent from the following description of a preferred embodiment, considered along with the accompanying drawings.

BRIEF DESCRIPTION OF THE DRAWINGS

In the drawings, closely related items have the same reference numeral.

DETAILED DESCRIPTION OF THE DRAWINGS

In accordance with the present invention, a holder for a violin, viola or other shoulder-engageable musical instrument is configured so as to fit around the neck of the musician and engage from the right side of the neck, around the back of the neck and down over the collar-bone to the upper chest. The holder may be formed in two separate pieces which are attached together for use: the neck and chest-engaging portion or brace; and a clamping device that secures to the end of the violin including an insertion mechanism that allows the clamping device to secure to the brace by an inserting member fixed to the lower portion of the brace. So, therefore, with the above configuration, the instrument is held in a fixed position relative to the user and need not be gripped using the chin and shoulder as is now customary.

Figure 1:
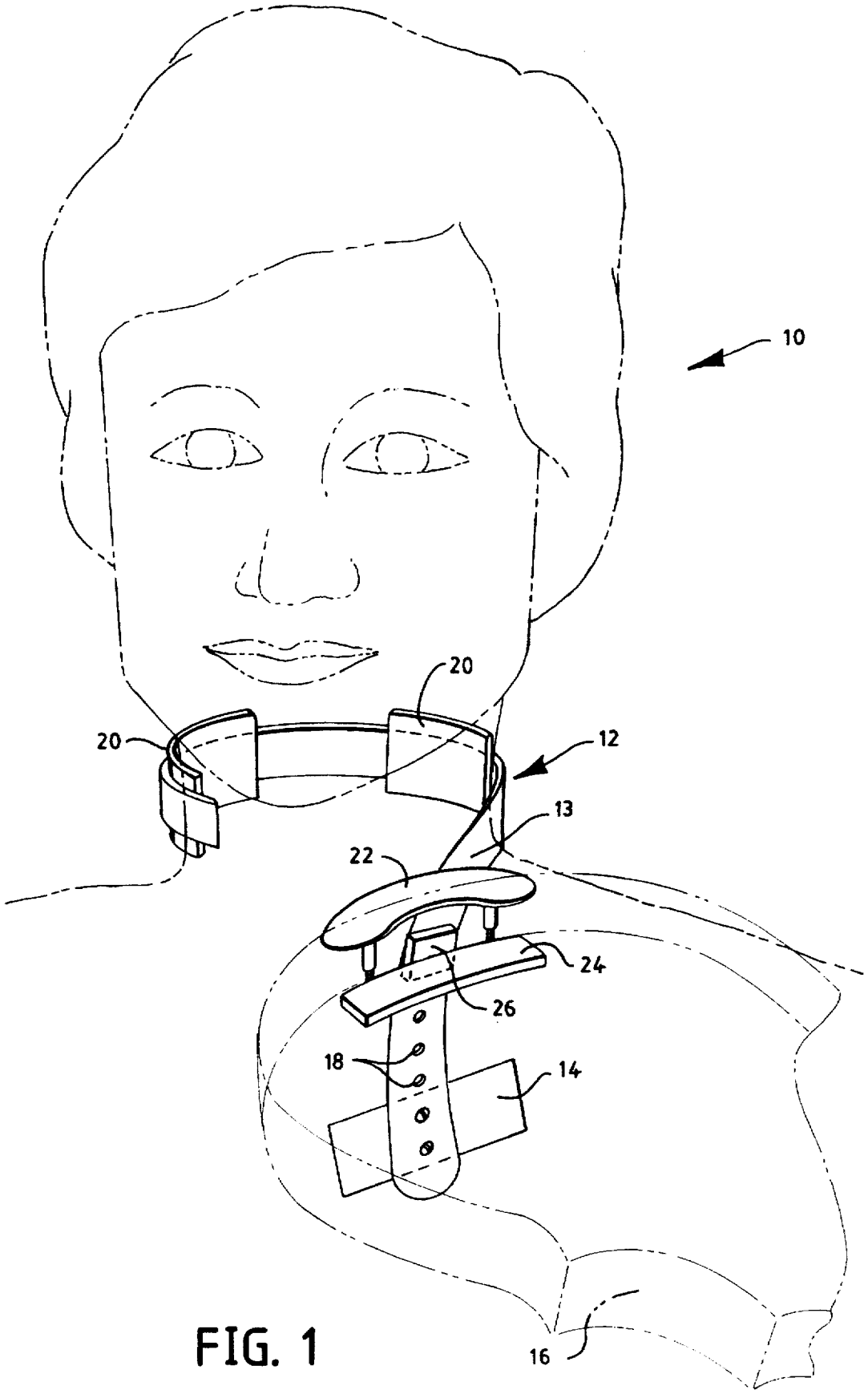
FIG. 1 shows the brace as it would appear on a user.

A typical embodiment of the present invention 12, as seen on the user 10, is illustrated in FIG. 1. A metal band is shaped to curve from the right side of the users neck 10, around the back of the neck and down, around the left side of the neck towards the chest. The portion of the brace below the collar-bone is denoted by reference numeral 13. Attached to the inner side of the brace, where it contacts the neck, are pads 20, that provide a more comfortable fit, preventing direct contact of the brace against the spinal column, and allowing the user to easily adjust the fit of the brace around the neck. On the end of the lower portion of the brace 13 is a chest-plate 14 that supports and balances the downward pressure exerted by the weight of the instrument. The chest plate can be of a small or larger size, depending on the desired stability, and padding can be added to the inner side of the chest-plate in order to cushion the area of contact. The chest-plate 14 is adjustable along a line of screw-holes 18, so that the user can change the point of contact of the chest-plate on the upper chest to accommodate a particular physiology. The insertion prong 28 is adjustable along the same line of screwholes 18 as the chest-plate. The hinge that allows a more compact storage of the device is denoted by reference numeral 11.

Figure 2:
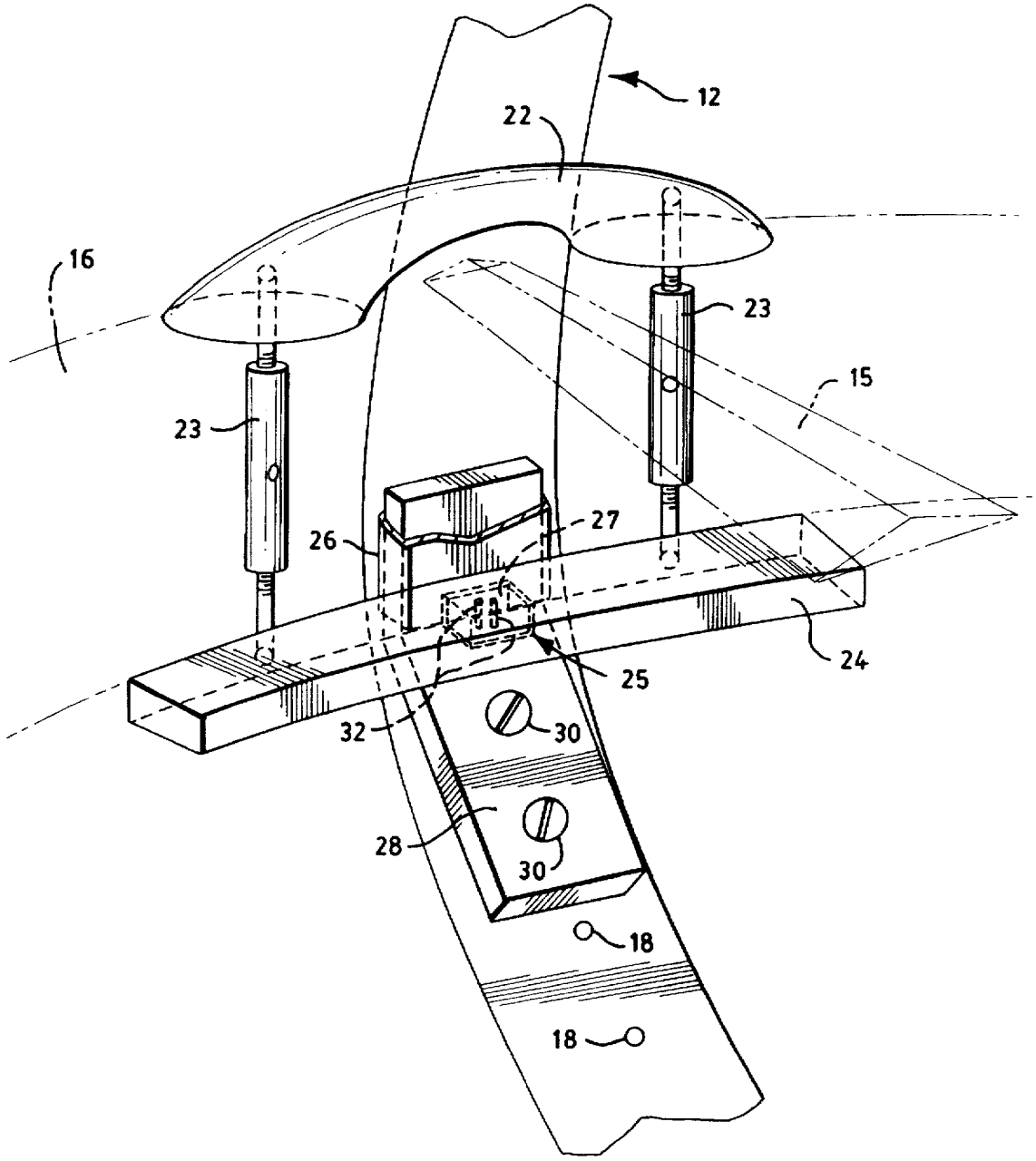
FIG. 2 hows the clamping mechanism attached to the violin or viola, center mounted over the tail-piece, with an upper-clamp beam, and lower-clamp beam. The insertion housing is shown in section with the insertion prong mated with the housing.

In FIG. 2 we are shown a magnified view of the mechanism that attaches to the proximal end of the instrument. It attaches to the instrument in the same manner as a standard chin-rest but does not have the cup for the chin. It consists of an upper clamp beam 22 and a lower clamp beam 24 that are tightened with barrel nuts 23 go that the upper clamp beam 22 and lower clamp beam 24 fit snugly on the end of the instrument over the tail-piece 15, though future embodiments of the device could attach to either side.

Figure 3:
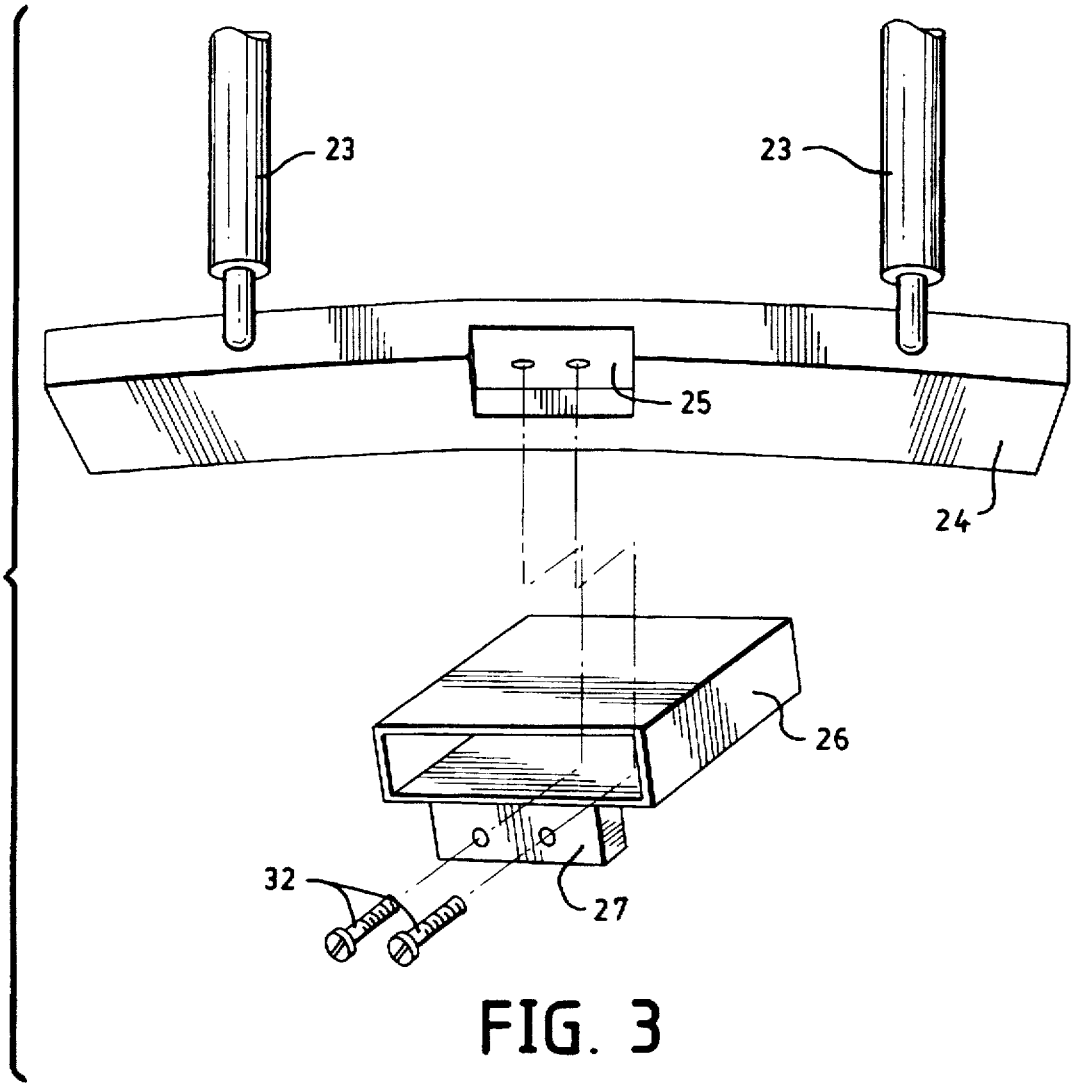
FIG. 3 shows an exploded view of the lower clamp beam, the insertion notch and the insertion housing with its insertion tab.

At a point near the middle of the lower clamp beam is a rectangular insertion notch 25, though alternative embodiments could employ different means for attaching, that is recessed inward from the lower outer edge of the lower clamp beam 24. The insertion notch 25 is designed to receive and fit snugly with the insertion tab 27 that protrudes from the insertion housing 26. FIG. 3 is an opposing and exploded view of the lower clamp beam 24 with a view of the rectangular insertion notch in the middle of the outer, lower edge of the lower clamp beam 24. The insertion housing 26 is exploded from the lower clamp beam 24 where it would normally rest snugly within the insertion notch 25, and be fastened by two screws 32, though other embodiments could employ different means for attaching.

Figure 4A:
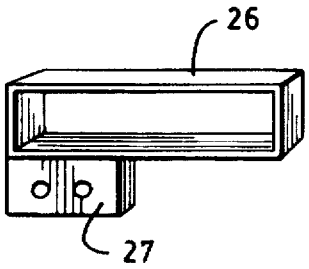
FIG. 4A and 4B show two alternative insertion housings that allow for adjusting the position of the instrument relative to the neck.
Figure 4B:
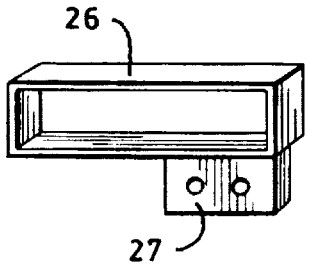

FIG. 4 shows variations of the insertion housing 26 that would allow for adjusting the position of the instrument relative to the neck. By moving the insertion tab 27 from one side of the housing to the other, the instrument is shifted to the left or right of the musician a corresponding distance. Other embodiments could incorporate different shaped insertion housings and prongs, beveled housings and prongs for ease of insertion or a sliding mechanism that would allow a greater and finer degree of adjustability.

Figure 5A:
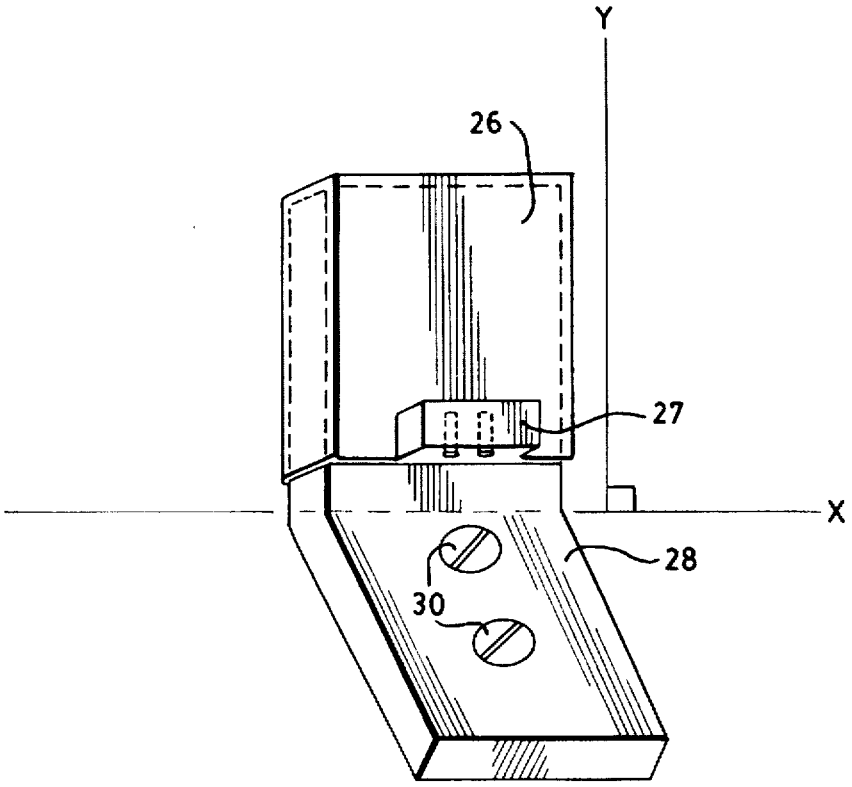
FIG. 5A and 5B show the insertion prong mated with the insertion housing. 5B is a variant of 5A with a different degree of tilt allowing for adjustability.
Figure 5B:
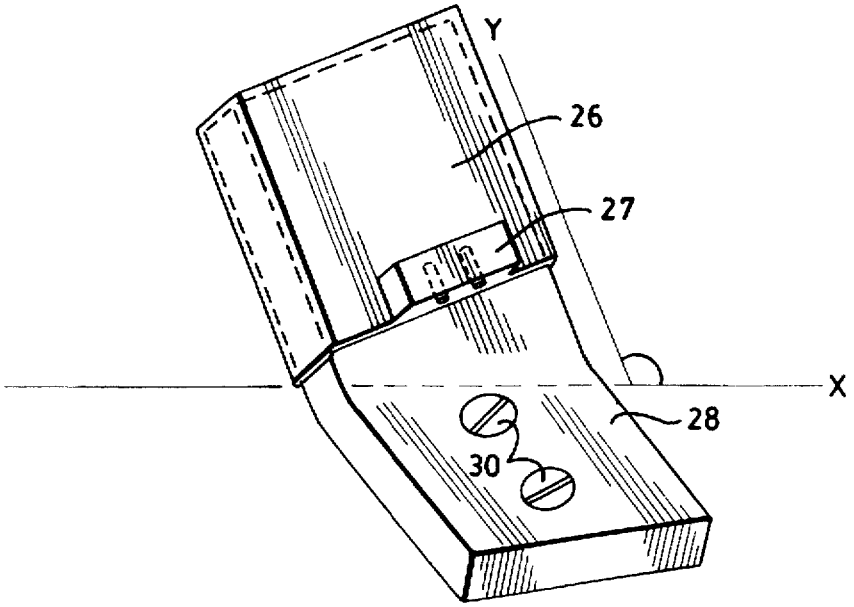

FIG. 5A shows a closer view of the insertion prong 28 mated with the insertion housing 26. The prong fits snugly to the inner surface of the housing and does not allow any relative movement except the one movement, along the y axis shown, that allows the prong to free itself from within the housing. FIG. 5B shows a variant of FIG. 5A with a different degree of tilt. The user may be provided with a variety of insertion prongs 28 with differing degrees of tilt so that the user may customize the angle of the instrument to the desired degree.

Accordingly, the reader will see that the present invention has many advantages to the present methods employed in holding violins, violas and other shoulder engageable instruments. The present invention allows the user to play without gripping the instrument between the shoulder and chin that can lead to a common problem of muscular tension in the shoulder and jaw leading to discomfort, fatigue, and a reduction in facility and the quality of performance. The present invention has the additional advantages in that

- it provides greater stability than other instrument holding devices.
- it is unobtrusive on the musician and can be easily hidden under clothing
- it can be easily designed with a hinge for compact storage within the musicians case
- it promotes a more natural posture by freeing the head and chin from any role in holding the instrument, thus allowing the user to stand in a natural manner.
- it is adjustable to allow the user to configure the device for a particular body type or playing style Although the above descriptions have included many specificities, these should in no way be construed as limiting the scope of the invention but as merely providing illustrations of some of the presently preferred embodiments of the invention.

The above described preferred embodiment illustrates the principles of the present invention, but is not intended to limit the scope of the invention. Other embodiments and variations to these preferred embodiments will be apparent to those skilled in the art and may be made without departing from the scope of the invention as defined in the following claims. Thus the scope of the invention should be determined by the appended claims and their legal equivalents, rather than by the examples given.

I claim:

1. A support assembly for a shoulder-engageable musical instrument, comprising:

A. a brace adapted for resting engagement against a portion of a user's body, said brace including an upper bearing portion and a lower bearing portion, and B. an attachment assembly for removably attaching said instrument to said brace at one end of the instrument, wherein during use said instrument is disposed in said support assembly in a predetermined orientation relative to said user, wherein said upper bearing portion of said brace is adapted for resting engagement with a portion of said user's neck, and wherein said upper bearing portion further includes at least one spacer element disposed between said upper bearing portion and said user's neck, wherein said brace exerts substantially no pressure on the vertebrae in said user's neck.

2. A support assembly according to claim 1, wherein said upper bearing portion is adjustable in the direction of a circumferential axis extending along the circumference of said user's neck.

3. A support assembly according to claim 1, wherein said lower bearing portion terminates in a bearing plate adapted for resting engagement with a portion of said user's chest.

4. A support assembly according to claim 1, wherein said attachment assembly comprises:

A. a positioning assembly affixed to said brace near said lower bearing portion for supporting said instrument at said one end thereof in a fixed orientation relative to said user, said positioning assembly including:

i. a housing extending along a housing axis, and ii. an orientation element extending in the direction of said housing axis and being adapted for mating engagement with said housing, wherein relative movement of said orientation element and said housing is constrained except in the direction of said housing axis, and B. a clamp assembly engageable with said one end of said instrument and adapted for mating engagement with a portion of said positioning assembly, said clamp assembly including:

i. a plurality of support beams, and ii. means for adjustably positioning said beams relative to one another about said instrument.

5. A support assembly according to claim 4, wherein one of said support beams is adapted for mating engagement with a portion of said orientation element.

6. A support assembly according to claim 4, wherein said adjustable positioning means comprises at least one barrel screw.

7. In a shoulder-engageable musical instrument, the improvement comprising:

A. a support assembly, including:

i. a brace adapted for resting engagement against a portion of a user's body, said brace including an upper bearing portion and a lower bearing portion, and ii. an attachment assembly for removably attaching said instrument to said brace at one end of the instrument, wherein during use said instrument is disposed in said support assembly in a predetermined orientation relative to said user, wherein said upper bearing portion of said brace is adapted for resting engagement with portion of said user's neck, and wherein said upper bearing portion further includes at least one spacer element disposed between said upper bearing portion and said user's neck, wherein said brace exerts substantially no pressure on the vertebrae in said user's neck.

8. A shoulder-engageable musical instrument according to claim 7, wherein said upper bearing portion is adjustable in the direction of a circumferential axis extending along the circumference of said user's neck.

9. A shoulder-engageable musical instrument according to claim 7, wherein said lower bearing portion terminates in a bearing plate adapted for resting engagement with a portion of said user's chest.

10. A shoulder-engageable musical instrument according to claim 7, wherein said attachment assembly comprises:

A. a positioning assembly affixed to said brace near said lower bearing portion for supporting said instrument at said one end thereof in a fixed orientation relative to said user, said positioning assembly including;

i. a housing extending along a housing axis, and ii. an orientation element extending in the direction of said housing axis and being adapted for mating engagement with said housing, wherein relative movement of said orientation element and said housing is a constrained except in the direction of said housing axis, and B. a clamp assembly engageable with said one end of said instrument and adapted for mating engagement with a portion of said positioning assembly, said clamp assembly including:

i. a plurality of support beams, and ii. means for adjustably positioning said beams relative to one another about said instrument.

11. A shoulder-engageable musical instrument according to claim 10, wherein one of said support beams is adapted for mating engagement with a portion of said orientation element.

12. A shoulder-engageable musical instrument according to claim 10, wherein said adjustable positioning means comprises at least one barrel screw.

* * * * *